United States Patent [19]

Guresh et al.

[11] 3,992,902

[45] Nov. 23, 1976

[54] SUPPORT DEVICE FOR CYLINDER OF A CIRCULAR KNITTING MACHINE

[75] Inventors: Stephen G. Guresh, Robesonia; James Heilig Boyer, Jr., Shillington, both of Pa.

[73] Assignee: Rockwell International Corporation, Pittsburgh, Pa.

[22] Filed: Sept. 23, 1975

[21] Appl. No.: 616,088

[52] U.S. Cl. ..... 66/8

[51] Int. Cl.[2] ..... D04B 9/00

[58] Field of Search ..... 66/8, 55, 27, 13, 19, 66/82 R, 82 CU, 86 F, 9 A, 153

[56] References Cited

UNITED STATES PATENTS

| | | | |
|---|---|---|---|
| 1,988,359 | 1/1935 | Larkin | 66/19 |
| 2,108,705 | 2/1938 | Broadwin | 66/8 |
| 2,618,138 | 11/1952 | Peel et al. | 66/86 F |
| 2,983,127 | 5/1961 | Cobert | 66/82 R |

FOREIGN PATENTS OR APPLICATIONS

| | | | |
|---|---|---|---|
| 1,077,219 | 11/1954 | France | 66/8 |
| 1,137,164 | 9/1962 | Germany | 66/55 |
| 868,428 | 5/1961 | United Kingdom | 66/8 |

*Primary Examiner*—Mervin Stein
*Assistant Examiner*—Andrew M. Falik

[57] ABSTRACT

A support device is provided for an elongated rotatable needle cylinder of a circular knitting machine having vertically located stitch cams where the cylinder has an upper end which supports an array of sinkers and a lower end. The support device includes a rotatable base portion located a predetermined vertical distance below the stitch cams. A plurality of rods extends from the base portion upwardly along the interior of the cylinder and terminates at an upper portion of the support device. The upper portion is secured to the upper end of the cylinder so that the lower end of the cylinder is free to move vertically with respect to the stitch cams when the cylinder expands and contracts during knitting.

5 Claims, 1 Drawing Figure

SUPPORT DEVICE FOR CYLINDER OF A CIRCULAR KNITTING MACHINE

BACKGROUND OF THE INVENTION

1. Field of the Invention.

This invention relates to a support device for a needle cylinder of a circular knitting machine and, more specifically, to such a device which can minimize the effect of expansion and contraction of the cylinder which might occur during knitting.

2. Description of the Prior Art

It has heretofore been found in circular knitting machines that the mounting configuration for the needle cylinder often results in it being susceptible to expansion and contraction as a result of heat generated during knitting. The linear expansion of a cylinder fixedly mounted at its lower end has an undesirable effect on the knitted article by causing the stitch size to uncontrollably vary. This uncontrolled variation becomes more of a problem as higher knitting machine speeds are obtained and produce higher operating temperatures.

An array of sinkers for the machine are supported at and move with the upper portion of the needle cylinder and the stitch size is determined by the distance between the sinkers and a vertically located stitch cam. If the needle cylinder is mounted at its lower end, expansion of the cylinder changes the vertical relationship of the sinkers to the stitch cam to cause the undesired alteration of the stitch size.

SUMMARY OF THE INVENTION

It is therefore an object of the present invention to provide a support device for the cylinder to help maintain a predetermined vertical relationship between the sinkers and the stitch cam throughout knitting.

To accomplish this and other objects of the invention, a preferred embodiment includes a support device for an elongated rotatable needle cylinder of a circular knitting machine which has vertically located stitch cams. The cylinder has an upper end which supports an array of sinkers and a lower end. The support device includes a rotatable base portion which is located a predetermined vertical distance below the stitch cams. A vertical support structure is fixed to the base portion and extends upwardly therefrom along the interior of the cylinder. An upper portion of the support device is fixed to the vertical support structure and is secured to the cylinder at its upper end. The lower end of the cylinder is free to move vertically with respect to the stitch cam when the cylinder expands and contracts during knitting.

DETAILED DESCRIPTION OF THE PREFERRED EMBODIMENT

Figure 1:
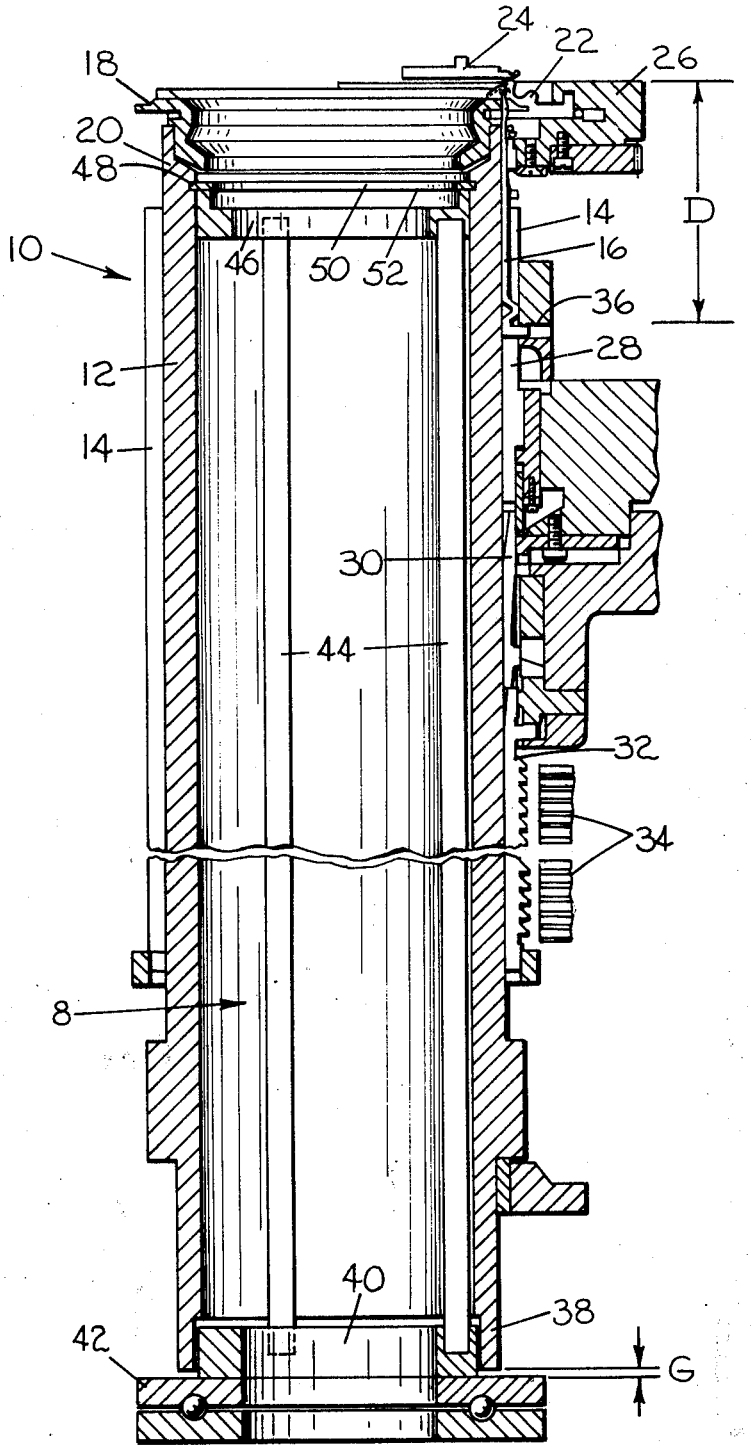
FIG. 1 is a sectional side view of a knitting machine including various features of the invention.

As seen in FIG. 1, a preferred support device 8 is utilized in a circular knitting machine 10 which includes an elongated needle cylinder which is rotated by any suitable means (not shown) well known by those skilled in the knitting machine art. The figure is generally simplified by omitting a number of components of the knitting machine at the left of the drawing to clearly show the relationship of the support device 8 and the cylinder 12. The cylinder 12 includes a slot 14 for each needle 16. An inner sinker ring 18 is mounted at an upper end 20 of the cylinder 12 and supports an array of sinkers 22. A dial sinker 24 and an outer sinker ring 26 which controls movement of the sinkers 22 is also shown for the preferred machine 10.

In addition to a needle 16, each slot 14 includes a lifter jack 28, a rocker jack 30 and a slider jack 32 which are utilized in the selection of needles 16 which are to be raised for knitting. The needle selection means shown in the preferred machine 10 is provided by way of example but, as will be understood, might be altered without affecting the present invention. Nevertheless, to continue with the example, a selection control system causes selector slide cams 34 to be inserted into the path of the slider jacks 32. A selected needle 16 will be raised by the rocker jack 30 through the lifter jack 28 to a knitting height.

Each needle 16 which has been raised for knitting is then lowered to form a knitting stitch by an actuation or stitch cam 36. The stitch cam 36 is said throughout this specification and claims to be "vertically located" during knitting but nevertheless includes the type of stitch cam which can be vertically adjusted for preselecting a desired stitch size prior to knitting a particular fabric and the type of stitch cam which may at one or more stations be vertically repositioned during knitting for a patterned alteration in stitch size at that station. The size of the stitch is determined by the distance between the sinker 22 and the needle 16 as it is lowered by the stitch cam 36 and is established, when the length of needle 16 is known, by the distance D between the stitch cam 36 and the sinker 22. Consequently, if the cylinder 12 is vertically fixed at its lower end 38 and if the cylinder expands during knitting, the distance D will increase to alter the stitch size as the sinkers 22 are raised.

To prevent this undesired result during expansion of the cylinder 12, the support device 8 of the present invention is provided. The support device 8 includes a base portion 40 which is located a predetermined vertical distance below the stitch cam 36 by being mounted to the upper portion of a thrust bearing 42 of the machine 10. Although in some machines the thrust bearing 42 may be vertically moved during knitting for a planned alteration of the needle stitch size at each station according to a knitting pattern for some fabrics, the distance below the stitch cam 36 is still "predetermined." Like the adjustment to the stitch cam 36 mentioned hereinabove, this movement will not compensate for unpredictable cylinder expansion.

In the preferred support device 8, the base portion 40 is in the form of a metal ring to which three support rods 44 are secured. The support rods 44 provide a vertical support structure for the device 8 and are evenly spaced about the base portion 40 and extend upwardly along the interior of the cylinder 12. The support rods 44 terminate at and are secured to an upper portion 46 of the support device 8 which is also in the form of a metal ring. The upper support portion 46 closely encircles the interior of the cylinder 12 at its upper end 20.

To vertically mount the cylinder 12 to the support device 8, a circumferential groove 48 is provided about the interior of the cylinder 12. A retaining ring 50 is installed in the circumferential groove 48 to provide a surface 52 which rests against the upper portion 46 to support the weight of the cylinder 12. The relative lengths of the support device 8 and the cylinder 12 are such that when the cylinder 12 is mounted as described hereinabove, its lower end 38 is separated by a gap G from the thrust bearing 42. As the cylinder 12 is subjected to heating during knitting, it will expand in a direction to decrease the size of the gap G without making contact with the thrust bearing 42. As a result, the expansion of the cylinder does not alter the distance D described hereinabove which affects the size of the stitch.

Since the heat which causes expansion of the cylinder is produced by the movement of the needles, jacks, etc., relative the cylinder, the cylinder itself is the source of the heat. By separating support rods 44 from direct contact with the cylinder 12 and by their general separation from each other which allows air to flow about their exterior surfaces, the support rods 44 do not reach as high a temperature as does the cylinder 12. This insulating factor alone would greatly decrease any expansion of the support rods 44 which might alter the distance D. Additionally, to insure that the support rods 44 do not significantly expand, they are formed of a metal having a significantly lower coefficient of the thermal expansion than, for example, the coefficient of thermal expansion of the metal of which the cylinder 12 is made.

It should be apparent from the description provided hereinabove, that various alterations in and modifications of the support device might be employed without departing from the spirit or scope of the invention as claimed hereinbelow.

What is claimed is:

1. A support device for an elongated, rotatable needle cylinder of a circular knitting machine having vertically located stitch cams, said cylinder having an upper end which supports an array of sinkers at a predetermined height above said stitch cams and a lower end, said support device comprising:

a rotatable base portion located at said lower end of said cylinder and at a predetermined vertical distance below said stitch cams, a vertical support structure fixed to said base portion and extending upwardly therefrom along an interior of said cylinder, and an upper portion fixed to said vertical support structure and secured to said cylinder at said upper end, whereby said lower end of said cylinder is free to move vertically with respect to said stitch cams to maintain said predetermined height at a constant value when said cylinder expands and contracts.

2. A support device as set forth in claim 1 wherein said vertical support structure is separated from said cylinder to be generally insulated from the effects of heating of said cylinder.

3. A support structure as set forth in claim 1 wherein said vertical support structure is composed of a material having a lower coefficient of thermal expansion than does the material of said cylinder.

4. A support device as set forth in claim 1 wherein said vertical support structure includes a plurality of rods which extend between said base portion and said upper portion.

5. A support device as set forth in claim 1 wherein said upper end of said cylinder includes a circumferential groove about its interior surface, said groove receives a retaining ring, and said retaining ring rests on said upper portion of said support device as said cylinder depends therefrom.

* * * * *